US009376739B2

(12) United States Patent
Kulakovsky

(10) Patent No.: US 9,376,739 B2
(45) Date of Patent: Jun. 28, 2016

(54) DEVICE FOR APPLYING A COATING TO AN EXTENDED ARTICLE

(76) Inventor: Aleksandr Aleksandrovich Kulakovsky, Moscow (RU)

( * ) Notice: Subject to any disclaimer, the term of this patent is extended or adjusted under 35 U.S.C. 154(b) by 0 days.

(21) Appl. No.: 14/383,168

(22) PCT Filed: Mar. 23, 2012

(86) PCT No.: PCT/RU2012/000206

§ 371 (c)(1),
(2), (4) Date: Sep. 5, 2014

(87) PCT Pub. No.: WO2013/141739

PCT Pub. Date: Sep. 26, 2013

(65) Prior Publication Data

US 2015/0047558 A1 Feb. 19, 2015

(51) Int. Cl.

| | |
|---|---|
| ***C23C 2/36*** | (2006.01) |
| ***C23C 2/00*** | (2006.01) |
| ***C23C 2/38*** | (2006.01) |
| ***C23C 2/40*** | (2006.01) |
| ***B05C 3/02*** | (2006.01) |
| ***B05C 3/09*** | (2006.01) |
| ***B05C 3/10*** | (2006.01) |
| ***B05C 3/12*** | (2006.01) |
| ***B05C 3/132*** | (2006.01) |

(52) U.S. Cl.

CPC ... *C23C 2/36* (2013.01); *B05C 3/02* (2013.01); *B05C 3/09* (2013.01); *B05C 3/10* (2013.01); *B05C 3/12* (2013.01); *B05C 3/125* (2013.01); *B05C 3/132* (2013.01); *C23C 2/003* (2013.01); *C23C 2/38* (2013.01); *C23C 2/40* (2013.01)

(58) Field of Classification Search

None

See application file for complete search history.

(56) References Cited

U.S. PATENT DOCUMENTS

| | | | | | |
|---|---|---|---|---|---|
| 3,738,312 | A * | 6/1973 | Padjen | C23C 2/003 | 118/420 |
| 3,965,857 | A * | 6/1976 | Baxter | C23C 2/38 | 118/405 |
| 4,173,663 | A * | 11/1979 | Bostroem | C23C 4/14 | 427/209 |
| 4,296,145 | A * | 10/1981 | Higuchi | B05C 9/02 | 118/410 |
| 5,702,528 | A * | 12/1997 | Paramonov | C23C 2/38 | 118/404 |
| 6,660,088 | B2 * | 12/2003 | Negishi | C22C 47/08 | 118/405 |
| 2002/0025260 | A1 * | 2/2002 | Maruyama | F04B 17/003 | 417/322 |
| 2006/0147643 | A1 * | 7/2006 | Volkov | C23C 2/006 | 427/431 |
| 2014/0366802 | A1 * | 12/2014 | Itoh | C23C 2/003 | 118/712 |

* cited by examiner

*Primary Examiner* — Dah-Wei D Yuan
*Assistant Examiner* — Jethro M Pence
(74) *Attorney, Agent, or Firm* — McKee, Voorhees & Sease, PLC

(57) ABSTRACT

The unit coat application by immersion elongate components into the molten metal comprises a tank for molten metal and a coating chamber equipped with appliances for internal creation of reduced pressure and positive pressure respectively. Moreover, inlet and outlet channels of the coating chamber are made vertical and situated at its bottom and top respectively to ensure vertical movement of the elongate component from bottom upwards. The coating chamber is located aside from the tank with molten metal, the intake channel is inclined, and the tank with molten metal is equipped with a supplying channel to load molten or solid metal that expands at its upper part facing the upper part of the tank with molten metal.

4 Claims, 1 Drawing Sheet

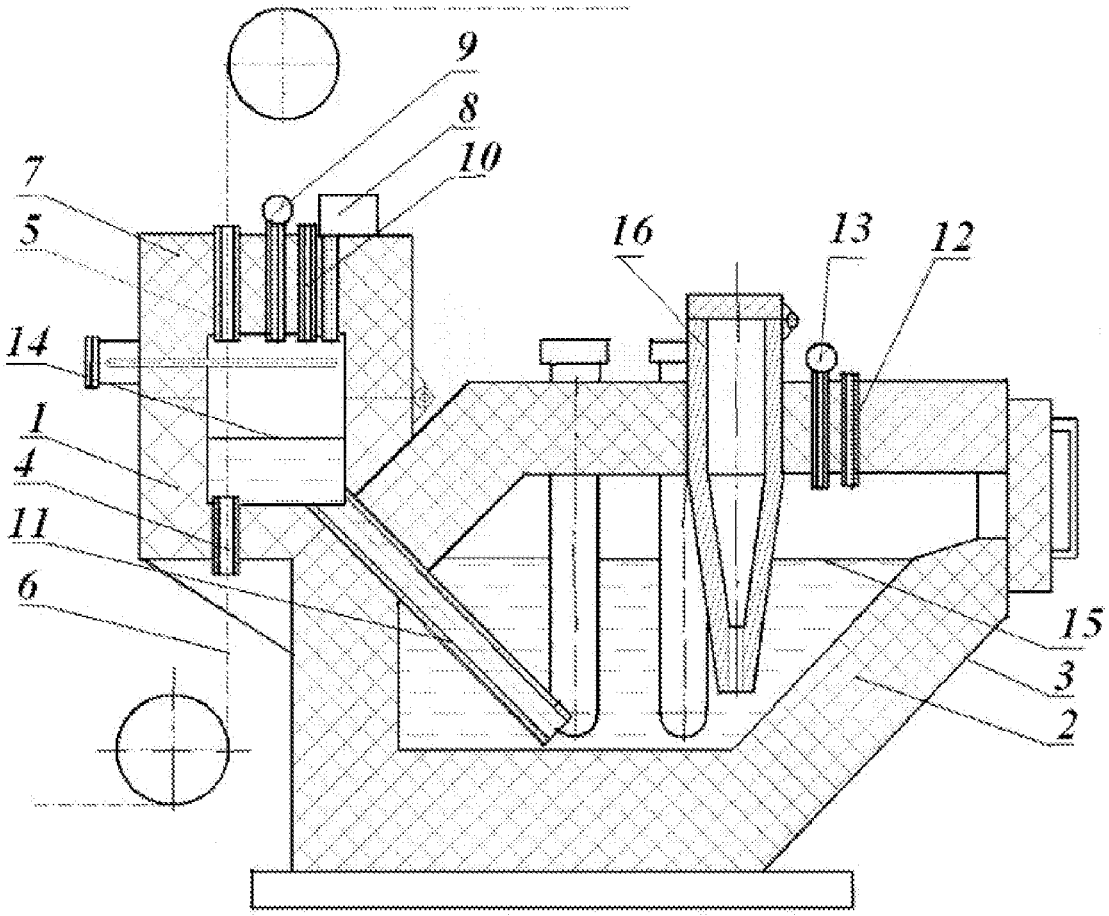
9
8
10
7
5
16
13
12
14
1
4
11
6
15
3
2

DEVICE FOR APPLYING A COATING TO AN EXTENDED ARTICLE

CROSS-REFERENCE TO RELATED APPLICATIONS

This is a National Phase application claiming priority to PCT/RU2012/000206 filed Mar. 23, 2012, which is herein incorporated by reference in its entirety.

This invention refers to technological equipment for lengthy product surface treatment equipment for continuous metal protective coatings application onto surfaces of elongate components such as wire, strip, etc., by its immersion into molten aluminium, zinc, their alloys, stannum, lead, etc. This invention could be used for hot aluminizing, galvanizing or galvaluming of long components made of cast iron or steel.

A unit for metal coat application onto the metal strips consisting of the tank for coat application that the strip is elongate through at the bottom of the tank is available. The strip is coiled supported by the columns, and it is elongate by the take-up roll located above the tank. The bottom part of the tank is surrounded with the ring-type supplying receiver equipped with a filling manifold at the side of molten metal supply, and with a plug on the side of molten metal unloading. Above the filling manifold a supplying ladle is available and it is equipped with a submerged tube installed in the filling manifold opening. The molten metal flows from the filling manifold into the ring-type supplying receiver, and then the molten metal appears on the strip processed that is located in the centre of the tank. If necessary, the molten metal in this tank and in the filling manifold is drawn via the draining hole into an extra tank located below the coating tank.

During the unit operation the draining hole is plugged (Russian Federation patent RU2127167, issued Oct. 3, 1999)

The disadvantage of this unit is complexity of the maintenance operations caused by the fact that the access to the coating tank is possible under condition of total draining of the molten metal from the tank and from the filling manifold. This feature of the unit leads to significant energy costs, as when the maintenance is over, it is necessary to remelt all the metal for the tank and the filling manifold to restart the unit operation.

A unit for coat application of the elongate metal component that consists of a tank with molten metal is available. The long components are supplied vertically from bottom upwards through the inlet opening at the tank bottom and outlet opening at the upper part of the tank. The tank with molten metal is located in the container where the positive pressure is maintained due to supply of inert gas to keep the metal inside the tank (GB2368596, issued Aug. 5, 2002).

The disadvantage of this unit is complexity of molten metal addition to the tank. For this purpose the unit shall be stopped completely in each case. This fact reduces its performance index and leads to extra energy costs for heating of molten metal to restart the unit operation.

A unit for coat application by immersing a metal blank into the molten metal is available. The metal blank is let through the tank with coating molten metal (zinc or aluminium) vertically and then further through the guiding channel. This unit is equipped with minimum two induction blocks located on both sides from the metal blank near the guiding channel to generate the electromagnetic field that keeps the coating metal inside the tank. When the metal blank is let from bottom to top through the coating unit, the coating metal is captured from the tank in the course of coat formation on the metal blank. Metal volume in the tank is refilled, to keep the required metal level, h, in the tank. Metal is added by the supplying system (from the supplying tank) and its pump supplies molten metal from the system into the coating tank (Russian Federation patent RU2339732, issued Oct. 4, 2006).

The disadvantage of this unit is that the molten metal is supplied into the chamber from the tank using the submerged pump, and this reduces significantly the equipment reliability required from the industrial equipment. Continuous molten metal circulation leads to rapid wear of channels, and the molten metal is contaminated with materials the channels are made of. All these factors worsen the coat formation quality and, consequently, reduce the coat quality.

Herewith, usage of molten aluminium is quite problematic because of its corrosive power.

A unit for coat application by immersing a metal blank into the molten metal is available. This unit consists of a tank with molten coating metal. The coating tank has two openings: upper and lower, which the blank (metal strip) is let through vertically in the molten metal from bottom upwards. The bottom opening is surrounded with an appliance creating electromagnetic field, which, in its turn, generates the electromagnetic force to prevent molten metal leakage from the coating tank. The unit is equipped with a tank for preliminary metal melting; the molten metal capacity of this tank is substantially bigger than the coating tank. The tank for metal preliminary melting is installed near the coating tank. The tank for preliminary melting is jointed with the coating tank via the inlet and outlet channels. The molten metal is supplied from the tank for preliminary melting by a pump through the inlet channel of the coating tank. The inlet and outlet channels are equipped with the heating appliances capable to control the molten metal temperature. At the coating tank outlet standard jet knives are installed to maintain the uniform material thickness. If any emergencies, when the appliance creating electromagnetic field is switched off because of, e.g., power failure, the bottom opening in the coating tank is closed by combined cutting off/shearing system. This system cuts a blank (strip) and at the same time closes the bottom opening preventing molten metal leakage from the coating chamber.

This unit disadvantage is similar to the disadvantage of the described above analogue (RU2339732), that is molten metal is supplied by the pump into the coating tank. Pump usage reduces the reliability and life cycle of the unit; some peculiarities of coat application are available due to molten aluminium corrosive power.

The closest technical analogue to the unit proposed is a unit for component surface process, more specifically, for coating application. This unit consists of a tank with molten metal (alloy) and the coating chamber located above the tank with inlet and outlet channels and vertical intake channel submerged into the molten metal in the tank. Positive pressure is generated in the tank and reduced pressure in the coating chamber to lift the molten metal vertically up along the intake channel into the coating chamber. The pressure difference in the cavities above the chamber and tank surfaces allows molten metal level to exceed above the inlet and outlet openings of the chamber.

Reduced pressure in the coating chamber also serves to prevent molten metal leakage from the coating chamber. Herewith, the following condition shall be satisfied:

$$P_{st} \geq P_1 + P_{m.col.},$$

where $P_{st}$—standard pressure $P_1$—pressure in the coating chamber $P_{m.col.}$—pressure of the molten metal column above the lower channel guide.

During the coating process pressure difference, $\Delta = P_{st} - (P_1 + P_{m.col.})$, is maintained at a constant level to avoid any leakage of the molten metal and penetration of free air inside the chamber through the inlet and outlet channels.

The disadvantage of this unit is that the coating chamber intake channel submerged into the molten metal is located vertically and this requires location of a coating chamber right above the tank with molten metal. Such a mutual alignment of the coating chamber and tank connected by the vertical channel, firstly, obstructs the unit maintenance and ensure no safety operation as any process stages related to component loading (e.g., wire), correction of some faults, are conducted in the area of high temperature, and forced usage of cooling loops will increase the risks of emergency situations; secondly, the construction of the unit requires regular stops of the coat application line containing the coating unit proposed because of the fact that compensation of consumed molten metal added into the tank is possible only when the coating chamber is drained dry from the molten metal. It results in reduced capacity and in increased energy costs.

Tank refilling is impossible without stopping the unit operation and without releasing the positive pressure as when the tank is opened the positive pressure will displace the molten metal in the tank over its lid and that is unacceptable. Horizontal loading of component subject to coating requires sufficiently high reduced pressure to keep the molten metal against leakage through the inlet and outlet opening of the coating chamber.

This unit helps to solve the issue related to safety, convenience and facilitation of the unit maintenance both during operation of the unit and during the tank with molten metal refilling, to energy costs reduction and to increase the unit work output.

This task is solved due to the fact that the unit for coating of elongate components consists of a tank for molten metal and coating chamber with inlet and outlet channels, and an intake channel submerged into the tank for molten metal; moreover, the coating chamber and tank with molten metal are equipped with devices intended for creation inside the tank and chamber above the heel of metal reduced pressure and positive pressure respectively. Herewith, to ensure the vertical movement of a long component from bottom upwards, the inlet and outlet channels of the coating chamber are manufactured vertical and located at its bottom and upper parts respectively (in its removable lid, preferably). The coating chamber is located adjacent and aside the tank with molten metal, the intake channel is inclined. The tank for molten metal is equipped with a supplying channel to fill it with the consumed molten or solid metal.

Besides, to ensure extra safety during the refilling operation, the supplying channel expands preferably at its upper part entering the tank with the molten metal, and the coating chamber is located so that the internal surface of its bottom is above the maximal possible molten metal level in the tank. The supplying channel for the tank for molten metal is located above the upper part of the tank (its lid) with molten metal and its height exceeds the maximal possible molten metal level in the coating chamber.

The technical result reached during this unit usage is the increase of operation convenience and safety, easy maintenance, provision of the continuous operation without any stops for refilling the tank, provision of safety when the tank is refilled with molten metal, as well as reduction of energy costs, increase of the unit work output and higher quality of the coat applied.

Achievement of the technical result is determined by significant features of this unit. The location of the coating chamber adjacent to the tank with molten metal facilitates the access to the coating chamber and to the equipment ensuring its operation (temperature control system, pressure sensor, molten metal level sensor, gas knives to remove the excess of molten metal, etc.).

At the same time this feature enables reduction of energy costs for molten metal lifting from the tank into the coating chamber; the location of the chamber above the tank for molten metal reduces the of positive pressure amount generated above the molten metal level in the tank. Adjacent location of the coating chamber and tank for molten metal (without interpenetration of tank lid by the chamber) allows refilling the tank to compensate the molten metal consumed without necessity to stop the process of the coating application that reduces the energy costs for molten metal heating in the tank (no heat losses when the unit operation is aborted and the lid is opened). To refill the tank, it is equipped with the supplying channel mounted so that its lower part is below the minimal possible molten metal level in the tank. This supplying channel enables loading additional batches of molten or solid metal (alloy) directly into the molten metal in the tank by opening its lid and without any operation abortion. Herewith, the safety is ensured as the positive pressure above the heel in the tank displaces the molten metal up along the supplying channel due to the pressure difference but not higher than the level of the molten metal in the coating chamber where the pressure is below the standard value. Whereby, any leakages of molten metal over the supplying channel are impossible also due to the expanded shape of the upper part of the supplying channel.

The coating chamber is located so that the internal surface of its bottom is below the maximal possible molten metal level in the tank. Such configuration facilitates the molten metal removal from the coating chamber, if necessary. When the positive pressure in the tank and reduced pressure in the coating chamber is released, the molten metal flows freely into the tank emptying the coating chamber.

The invention is explained by the drawing where in FIG. 1 the coating unit for long components is demonstrated:

The positions at the drawing indicate:

1—coating chamber;
2—tank for molten metal;
3—body frame of the tank for molten metal;
4—inlet channel of the coating chamber;
5—outlet channel of the coating chamber;
6—long component subject to coat application;
7—coating chamber lid;
8—sensor of molten metal level in chamber 1 for coating application 1;
9—sensor of reduced pressure in chamber 1 for coating application 1;
10—outtake manifold to generate reduced pressure in chamber 1 for coating application
11—inclined intake channel
12—supplying manifold to generate pressure in tank 2 for molten metal
13—pressure sensor in tank 2 for molten metal
14—molten metal level in chamber 1 for coating application
15—molten metal level in tank 2 for molten metal
16—supplying channel The unit for the coating application onto the long components, e.g., onto steel wire, consists of chamber 1 for coating application 1 and tank for molten metal 2 located close to the chamber. The tank for molten metal is an electric framed furnace for metal melting and soaking at a set temperature. The coating chamber 1 is equipped with an inclined intake channel 11 connecting the chamber 1 for coating application with the tank 2 for molten metal, and inlet 4 and outlet 5 channels made in the bottom of the chamber 1 for coating application 1 and in its lid 7 located in the upper part of the chamber respectively. The vertical inlet and outlet openings are located ensuring the vertical movement of a long component 6 subject to coat application. At the operation position the tank 2 for molten metal, chamber 1 for coating application 1 and inclined intake channel 11 are sealed to exclude the contact of the molten metal and ambient air. The upper part of the inclined intake channel 11 opens inside the chamber 1 for coating application through the opening at the bottom or through the opening in the side wall close to the bottom, or through the hole in the bottom and side wall. The lower part of the inclined intake channel 11 is connected to the cavity of tank 2 for molten metal below the possible molten metal level. Moreover, the inclined intake channel 11 is designed so that it excludes the connection of the air cavity above the molten metal in the tank 2 with coating chamber 1.

Molten metal can move along the inclined intake channel 11 up from the tank with molten metal 2 and fill the coating chamber 1 up to the set level.

Through the vertical channels, inlet 4 and outlet 5, elongate (long) components 6, e.g., wires, are moved through the molten metal in the coating chamber 1 to create the coat on the surface of the component.

The upper removable lid 7 of the coating chamber 1 is equipped with molten metal level control sensors 8, reduced pressure sensor 9, and temperature sensor. In the lid 7 the outtake channel with the outtake manifold 10 is made to generate reduced pressure in the chamber 1. The outtake manifold 10 is connected to the vacuum pump creating reduced pressure. The reduced pressure could be generated by the ejector. If necessary, the outtake manifold 10 could be mounted in the wall of coating chamber 1. The maintenance of sensors and equipment located on the lid 10 of the coating chamber 1 could be performed at any time and creates no obstructions due to the location of the coating chamber 1 aside from the tank 2 with molten metal.

The lid of the tank for molten metal (or upper part of its wall) is equipped with supplying channel with an intake manifold 12 to generate the positive pressure in tank 2 for molten metal. The intake manifold 12 is connected to the compressor creating the positive pressure in the tank 2 for molten metal. Moreover, the supplying channel 16 is installed in the tank 2 lid to refill the tank at the rate of molten metal consumption.

The chamber 1 for coating application and supplying channel 16 in the lid of the tank 2 are aligned so that the supplying channel 16 is higher than maximal possible molten metal level in the chamber 1 for coating application, and this excludes molten metal spilling when the lid of the tank 2 opens, due to the pressure difference of positive pressure inside the tank and ambient pressure outside.

Both the outtake and intake channels are located in the zone of air cavity above the molten metal level, preferably, in the lid of the tank 2 and lid of the chamber 1.

Initially the molten metal is in the tank 2 and partially in chamber 1 for coating application, if its bottom is below the molten metal level due to the adjacent location of tank with molten metal 1 and coating chamber 2 connected to the inclined channel 3 creating the connecting vessels.

Preferably the chamber 1 internal bottom surface is situated above the maximal possible molten metal level in the tank 2 to drain the molten metal totally into the tank 2 when the positive pressure and reduced pressure is released, and to empty the coating chamber 1 for, e.g., preventive maintenance or repair operations.

During the unit operation the molten metal level 14 in the chamber 1 for coating application is lifted up in comparison with the level 15 in the tank 2 due to creation of the pressure difference of the tank 1 and chamber 2.

When the positive pressure and reduced pressure is generated in the tank 2 with molten metal and in the coating chamber 1, the molten metal flows upwards along the channel 11 from the tank 2 into the chamber 1, and molten metal level 14 in the chamber 1 for coating application reaches the set operating level.

The coating unit is equipped with an appliance for molten metal control in the chamber 1 for coating application. Molten metal in chamber 1 for coating application is used continuously and the level of the molten metal 14 seeks to reduce. When the molten metal level 14 reduces, the difference of standard pressure and pressure in chamber 1 for coating application increases (due to $P_{m.col.}$ reducing) and this could lead to impact of air through the outlet channel 4 of the chamber 1 inside the chamber. This situation could violate the coating process and lead to some defects on the component surface.

Any known system could be applied for molten metal level control in the chamber 1 for coating application.

To add coating material into the tank 2 for molten metal, unit operation stop is not required. The supplying channel 16 located in the lid of the tank 2 and submerged into the molten metal below the minimal possible level in the tank is used to refill the tank. The opening of the lid of supplying channel 16 allows filling of additional batches of molten metal or solid metal (alloy) directly into the molten metal in the tank 2. The positive pressure above the heel in the tank 2 will displace the molten metal up along the supplying channel 16, but the molten metal column does not exceed the molten metal level in the coating chamber where the pressure is lower than the standard one.

Expanded upper part of the supplying channel 16 enables reduction of molten metal height along the supplying channel 16.

The invention claimed is:

1. A coating application unit configured to apply a coating by immersing elongate components into a molten metal, the unit comprising:

a tank configured for molten metal;

a coating chamber with inlet and outlet channels and an intake channel submerged into the tank configured for molten metal;

the coating chamber and the tank configured for molten metal being equipped with appliances configured for internal creation of reduced pressure and positive pressure respectively;

the inlet and outlet channels of the coating chamber extending vertically and situated at its bottom and top respectively to ensure vertical movement of the elongate component from bottom upwards;

the coating chamber being located aside from the tank with molten metal;

the intake channel being inclined; and the tank with molten metal being equipped with a supplying channel to load molten or solid metal.

2. The coating application unit according to the claim 1 wherein the supplying channel expands in the upper part facing the upper part of the tank with the molten metal.

3. The coating application unit according to the claim 1 wherein the coating chamber is located so that the internal surface of its bottom is above the maximal possible molten metal level in the tank.

4. The coating application unit according to the claim 1 wherein the supplying channel for the tank for molten metal is above the upper part of the tank with molten metal and its height exceeds the maximal possible molten metal level in the coating chamber.

* * * * *